US007469902B1

(12) United States Patent
Hale

(10) Patent No.: US 7,469,902 B1
(45) Date of Patent: Dec. 30, 2008

(54) PORTABLE, MOBILE, MOVING TARGET DEVICE

(76) Inventor: David J. Hale, 1974 62nd St., Somerset, WI (US) 54025

( * ) Notice: Subject to any disclaimer, the term of this patent is extended or adjusted under 35 U.S.C. 154(b) by 17 days.

(21) Appl. No.: 11/702,380

(22) Filed: Feb. 5, 2007

Related U.S. Application Data

(60) Provisional application No. 60/771,416, filed on Feb. 8, 2006.

(51) Int. Cl.
*F41J 9/02* (2006.01)

(52) U.S. Cl. ..... 273/359; 273/368

(58) Field of Classification Search ..... 273/359, 273/366–370

See application file for complete search history.

(56) References Cited

U.S. PATENT DOCUMENTS

| | | | | |
|---|---|---|---|---|
| 2,726,870 | A | 12/1955 | Auger | 273/105.2 |
| 3,303,821 | A | 2/1967 | Harris | 119/29 |
| 3,391,936 | A * | 7/1968 | Grimes | 473/439 |
| 3,802,706 | A | 4/1974 | Hamm | 273/105.2 |
| 3,917,270 | A * | 11/1975 | Gothard et al. | 273/359 |
| 3,947,033 | A * | 3/1976 | Bennett | 273/339 |
| 4,126,312 | A * | 11/1978 | Kreuzer et al. | 273/359 |
| 4,266,779 | A * | 5/1981 | English | 119/839 |
| 4,960,076 | A | 10/1990 | Snorgrass et al. | 119/29 |
| 4,981,302 | A | 1/1991 | Narramore | 273/339 |
| 4,995,618 | A * | 2/1991 | Panzner | 273/367 |
| 5,568,926 | A | 10/1996 | Kaptein | 273/359 |
| 5,775,698 | A | 7/1998 | Jones et al. | 273/359 |
| 6,945,534 | B1 * | 9/2005 | Lindsey | 273/359 |
| 2003/0034613 | A1 * | 2/2003 | Tisdell | 273/359 |

* cited by examiner

*Primary Examiner*—Mark S Graham
(74) *Attorney, Agent, or Firm*—Skinner and Associates

(57) ABSTRACT

A motorized moving target device having a chassis with an attachable animal model is able to travel in a circuitous path, enabling hunters to practice bow hunting at any time.

22 Claims, 12 Drawing Sheets

PORTABLE, MOBILE, MOVING TARGET DEVICE

CROSS REFERENCE TO RELATED APPLICATIONS

This application claims the benefit of Provisional Application 60/771,416, filed Feb. 8, 2006, which is herein incorporated in its entirety.

FIELD OF THE INVENTION

The invention relates to devices used by bow, gun, target and other shooters to practice against a moving target.

BACKGROUND

Successful shooting of any kind, be it bow, gun, target, police, military or any other kind, requires great skill, practice and patience. Because, for example, hunting seasons are typically limited to a few weeks or months a year, hunters are unable to practice against live targets except during hunting season. Depending on the year and location, even during hunting season, opportunities to practice against targets may be rare. What is clearly needed, then, is a device that presents a realistic, moving animal model that a hunter can easily set up and transport to a location and practice with at any time.

SUMMARY

In one aspect the invention comprises a moving target device having a frame which defines a longitudinal axis, a leading end, a following end and a midpoint. Mounting means are provided for attaching an animal model to the frame. A first wheel assembly defines a left wheel and a right wheel, which are separated by and attached to an axle. A second wheel assembly is also attached to the frame and the first and second wheel assemblies together support and allow the moving target device to be easily moved over a surface. A motor is coupled to the first wheel assembly, causing rotation of the first wheel assembly when the motor is energized. A tether defines a first end and a second end and is attached to the frame at a position beyond an area defined by the outer dimensions of the first wheel assembly so as to clear the first wheel assembly during movement. It is also noted that the tether is attached at the first end to the frame at a point between the leading end and the midpoint and at the second end to a surface, allowing the moving target device to travel in a circuitous path when the motor is energized.

In another aspect, the invention comprises a moving target device having a frame which defines a longitudinal axis, a leading end, a trailing end and a midpoint. Mounting means are provided for attaching an animal model to the frame. A first wheel assembly is attached proximate to the leading end of the frame and defines a left wheel and a right wheel separated by and attached to an axle. A second wheel assembly is attached proximate to the following end of the frame and the first and second wheel assemblies together support and allow the moving target device to be easily moved over a surface. A motor is coupled to the first wheel assembly, which causes rotation of the first wheel assembly when the motor is energized. A tether is attached to an inside part of the frame as the moving target device travels in a circuitous path, with the tether attached at one end to the frame at a position beyond an area defined by the outer dimensions of the inside wheel so as to clear the inside wheel during movement and at a point between the leading end and the midpoint and attached at another end to a surface. In this embodiment the inside wheel of the first wheel assembly defines a greater diameter than a diameter defined by the outside wheel, causing the tethered moving target device to exert a bias against the tether when the moving target device is moving.

In an alternative aspect, the invention comprises a moving target device having a frame, which defines a longitudinal axis, a leading end, a trailing end and a midpoint. Mounting means for attaching an animal model to the frame. A first wheel assembly is attached proximate to the leading end of the frame and defines a left wheel and a right wheel which are separated by and attached to an axle. A second wheel assembly is also attached to the frame proximate to the trailing end and the first and second wheel assemblies together support and allow the moving target device to be easily moved over a surface. A motor is coupled to the first wheel assembly, which causes rotation of the first wheel assembly when the motor is energized. A tether is attached to an inside part of the frame at a position beyond an area defined by the outer dimensions of the inside wheel so as to clear the inside wheel during movement and the tether and at one end to the frame at a point between the leading end and the midpoint and anchored at the other end to a surface, allowing the moving target device to travel in a circuitous path when the motor is energized. In this embodiment, the second wheel assembly is canted towards the inside wheel, which causes the tethered moving target device to exert a bias against the tether when the moving target device is moving.

DETAILED DESCRIPTION

Figure 1:
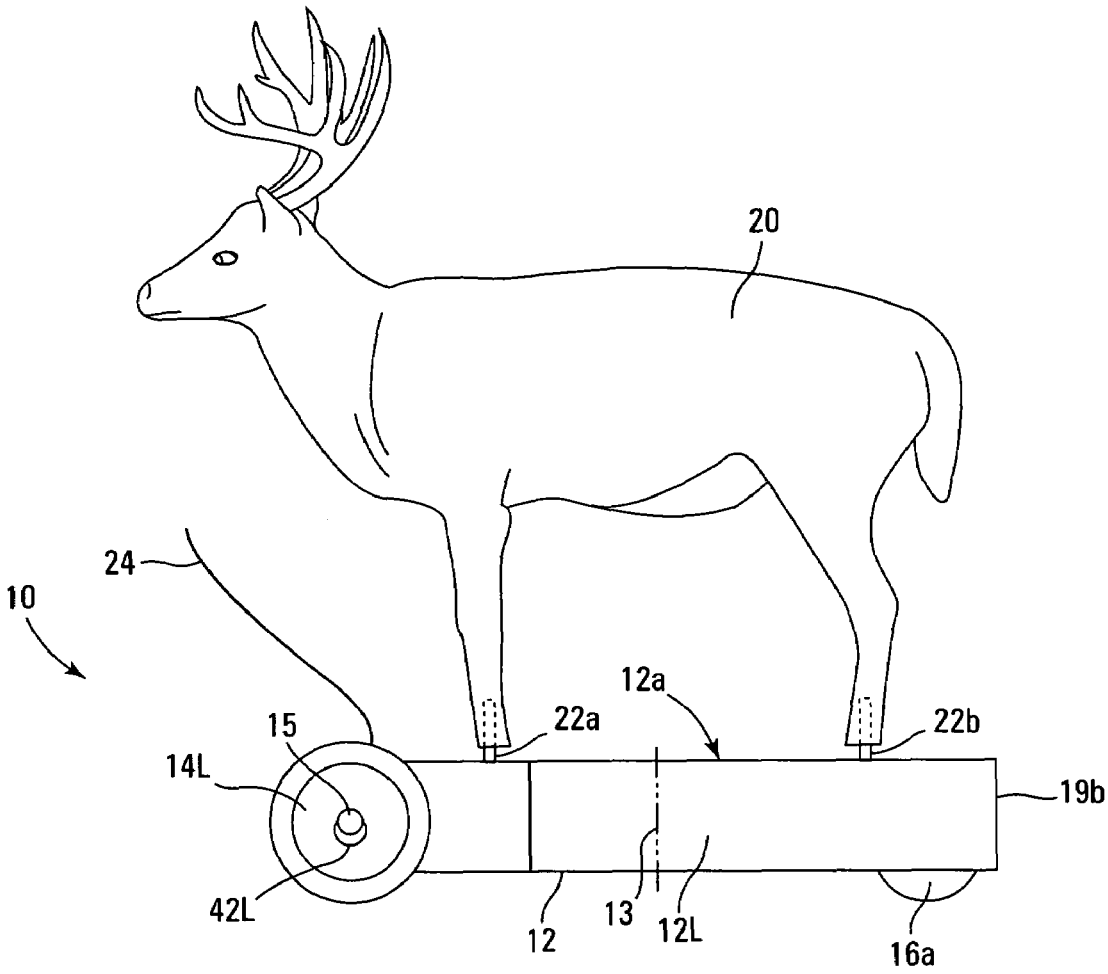
FIG. 1 is a side view of an embodiment of the moving target device of the present invention, with an animal model attached to the chassis.

The particulars shown herein are by way of example and for purposes of illustrative discussion of the invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Nomenclature

| | |
|---|---|
| 10 | Moving Target Device |
| 12 | Frame |
| 12a | Top Surface of Frame |
| 12b | Under Surface of Frame |
| 12L | Left Side of Frame |
| 12R | Right Side of Frame |
| 13 | Midpoint |
| 14 | First Wheel Assembly |
| 14L | Left Front Wheel |
| 14R | Right Front Wheel |
| 15 | First Axle |
| 16 | Second Wheel Assembly |
| 16a | Rear Wheel |
| 17 | Second Axle |
| 18 | Chassis |
| 19a | Leading End |
| 19b | Following End |
| 20 | Animal Model |
| 22a | First Stud |
| 22b | Second Stud |
| 23 | Second Stud Adjustment Slot |
| 24 | Antenna |
| 25 | Longitudinal Axis |
| 26 | Battery |
| 28 | Servo Gear Motor |
| 30 | Wireless Relay Receiver |
| 32 | Reduction Gearbox |
| 34 | Extra Aperture |
| 36 | Electrical Connection Between Servo Gear Motor and Battery |
| 38 | Electrical Connection Between Battery and Wireless Relay Receiver |
| 40 | Remote Transmitter |
| 42L | Swivel Attachment (Left) |
| 42R | Swivel Attachment (Right) |
| 44 | Tether |
| 44a | First End of Tether |
| 44b | Second End of Tether |
| 46 | Pivot Anchor |
| 100 | Moving Target Device |
| 112 | Frame |
| 112a | Top Surface of Frame |
| 112b | Under Surface of Frame |
| 112L | Left Side of Frame |
| 112R | Right Side of Frame |
| 113 | Midpoint |
| 114 | First Wheel Assembly |
| 114L | Left Front Wheel |
| 114R | Right Front Wheel |
| 115 | First Axle |
| 116 | Second Wheel Assembly |
| 116a | Rear Wheel |
| 117 | Second Axle |
| 118 | Chassis |
| 119a | Leading End |
| 119b | Following End |
| 122a | First Stud |
| 122b | Second Stud |

-continued

| | |
|---|---|
| 123 | Second Stud Adjustment Slot |
| 124 | Antenna |
| 125 | Longitudinal Axis |
| 126 | Battery |
| 128 | Servo Gear Motor |
| 130 | Wireless Relay Receiver |
| 132 | Reduction Gearbox |
| 134 | Extra Aperture |
| 136 | Electrical Connection Between Servo Gear Motor and Battery |
| 138 | Electrical Connection Between Battery and Wireless Relay Receiver |
| 142 | Swivel Attachment |
| 144 | Primary Tether |
| 146 | Pivot Anchor |
| 148 | Sliding Coupling |
| 150 | Secondary Tether |
| 200 | Moving Target Device |
| 212 | Frame |
| 212a | Top Surface of Frame |
| 212b | Under Surface of Frame |
| 212L | Left Side of Frame |
| 212R | Right Side of Frame |
| 213 | Midpoint |
| 214 | First Wheel Assembly |
| 214L | Left Front Wheel |
| 214R | Right Front Wheel |
| 215 | First Axle |
| 216 | Second Wheel Assembly |
| 216a | Rear Wheel |
| 217 | Second Axle |
| 218 | Chassis |
| 219a | Leading End |
| 219b | Following End |
| 222a | First Stud |
| 222b | Second Stud |
| 223 | Second Stud Adjustment Slot |
| 224 | Antenna |
| 225 | Longitudinal Axis |
| 226 | Battery |
| 228 | Servo Gear Motor |
| 230 | Wireless Relay Receiver |
| 232 | Reduction Gearbox |
| 234 | Extra Aperture |
| 236 | Electrical Connection Between Servo Gear Motor and Battery |
| 238 | Electrical Connection Between Battery and Wireless Relay Receiver |
| 242 | Swivel Attachment |
| 242 | Swivel Attachment |
| 244 | Primary Tether |
| 248 | Sliding Coupling |
| 250 | Secondary Tether |

DEFINITIONS

"Chassis" refers to the motorized moving target device before attaching an animal model.

"Front Half" refers to the portion of the moving target device extending from the leading end to a point halfway along the longitudinal exist defined by the length of the device.

"Inside" refers to a direction from the circuitously moving target device to the point where the tether is anchored to the surface.

"Outside" refers to the area outside perimeter of the area defined by the circuitously moving target device.

Construction

Figure 2:
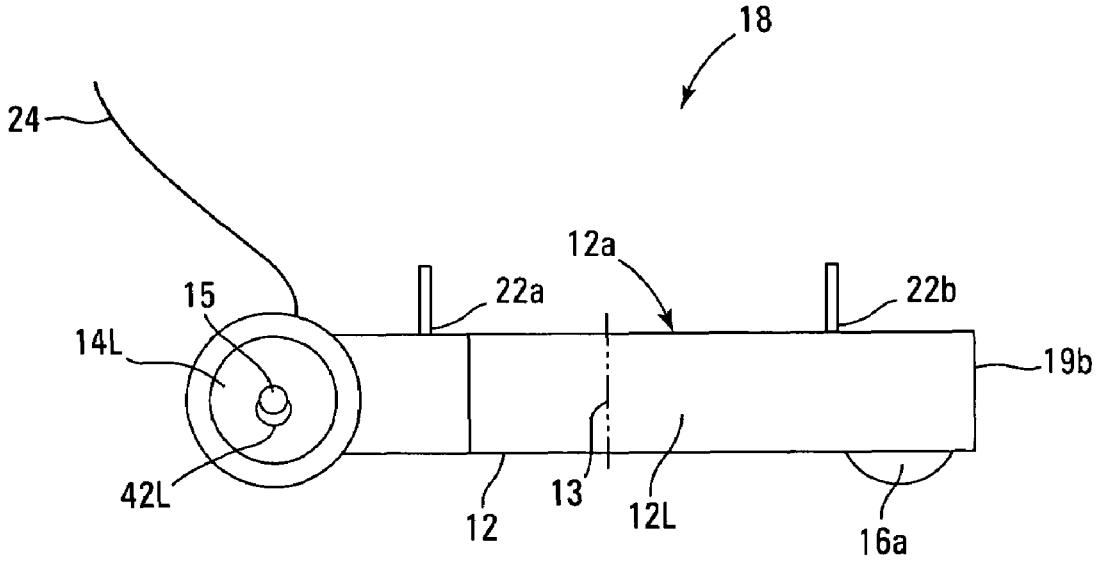
FIG. 2 is a side view of the embodiment of the moving target device of the embodiment shown in FIG. 1, without an animal model attached to the chassis.

FIG. 1 is a side view of an embodiment of the moving target device 10 of the present invention. It is seen that the moving target device 10 comprises a frame 12 on which all components are mounted, including a first wheel assembly 14 and a rear wheel assembly 16, to form a chassis 18, as best seen in FIG. 2. An animal model 20 is attached to the chassis 18 on a first stud 22*a* and a second stud 22*b* which extend upwardly from the chassis 18. For purposes of illustration a representation of a deer is used as the animal model 20, however, it is understood that any animal or other kind of target may be represented and that the invention is thus not considered so limiting. It should be noted that the animal model 20 could also be attached to the frame 12 by other methods such as fasteners, brackets etc. (not shown) and the invention should not therefore be considered as so limiting. An antenna 24 extends from the chassis 18 which is used to receive radio frequency signals that enable a user to remotely turn the moving target device 10 on and off, using a remote control unit 40.

Figure 3:
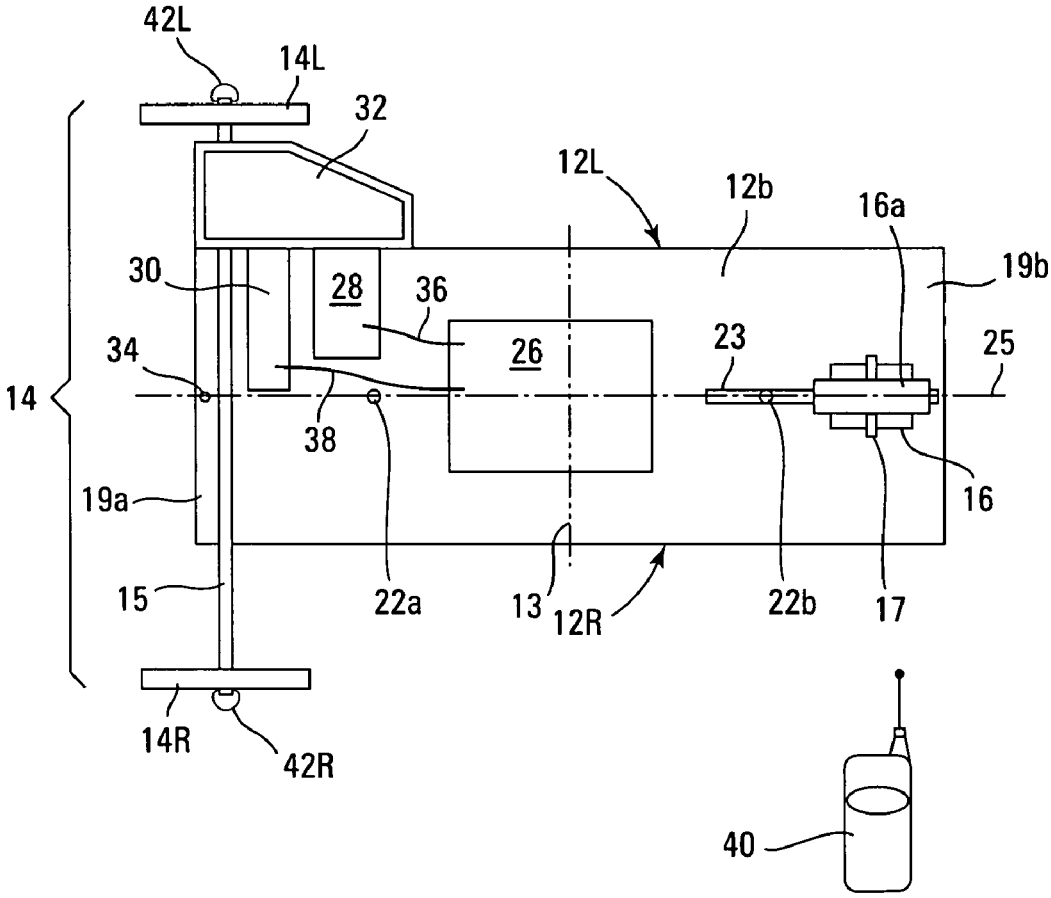
FIG. 3 is an under side view of the embodiment of the moving target device shown in FIGS. 1 and 2.

FIG. 3 is an underside view of the moving target device 10, showing the layout of the various components mounted thereon. It is seen that the frame 12 is the primary structural member and is made of aluminum or another similarly strong material, which in this embodiment is formed into a "U" configuration defining a top surface 12*a*, under surface 12*b*, left side 12L and right side 12R. A midpoint 13 is defined approximately halfway between a leading end 19*a* and a following end 19*b*. A longitudinal axis 25 is defined approximately halfway between the left side of the frame 12L and the right side of the frame 12R. Mounted to the underside 12*b* of the frame 12 are a battery 26, a servo gear motor 28, a wireless relay receiver 30 and a reduction gearbox 32, which is mechanically linked to the servo gear motor 28. Electrical connections 36, 38, such as wires function to provide electrical communication respectively between the battery 26 and the servo gear motor 32 and between the battery 26 and the wireless remote relay receiver 30. The first wheel assembly 14 comprises a first axle 15 which extends through the left side 12L and right side 12R of the frame 12 and has attached to its ends a left front wheel 14L and a right front wheel 14R. On its left side (unnumbered) the first axle 15 is coupled to and further passes through the reduction gearbox 32 which, as described above, is mechanically linked to the servo gear motor 28. The reduction gearbox 32 functions to reduce the relatively high speed revolutions achieved by the servo gear motor 28 to a lesser number of revolutions received by the first wheel assembly 14. This gives the moving target device 10 more power to travel over an uneven surface, at a realistic speed. Thus, when the servo gear motor 28 is energized by receiving electrical energy from the battery 26, it is caused to rotate and through its mechanical linkage to the reduction gear box 32, causes the first axle 15 to rotate, eventually causing the left front wheel 14L and the right front wheel 14R to rotate.

In one embodiment (not shown) energizing (i.e., turning the device on) of the moving target device 10 is initiated by closing a simple switch (not shown) mounted on the frame 12, then stepping out of the way and practicing shooting techniques. In the embodiment of the moving target device 10 as shown, the wireless (radio frequency) relay receiver 30 has an antenna 24 attached which extends approximately twelve to eighteen inches from the top surface 12*a* of the frame 12. An electrical connection (not shown) provides electrical communication between the antenna 24 and wireless relay receiver 30. The wireless relay receiver 30 is programmed to receive radio frequency signals from a remote transmitter 40 which in turn causes electrical energy to flow from the battery 26 to the servo gear motor 28.

Figure 4:
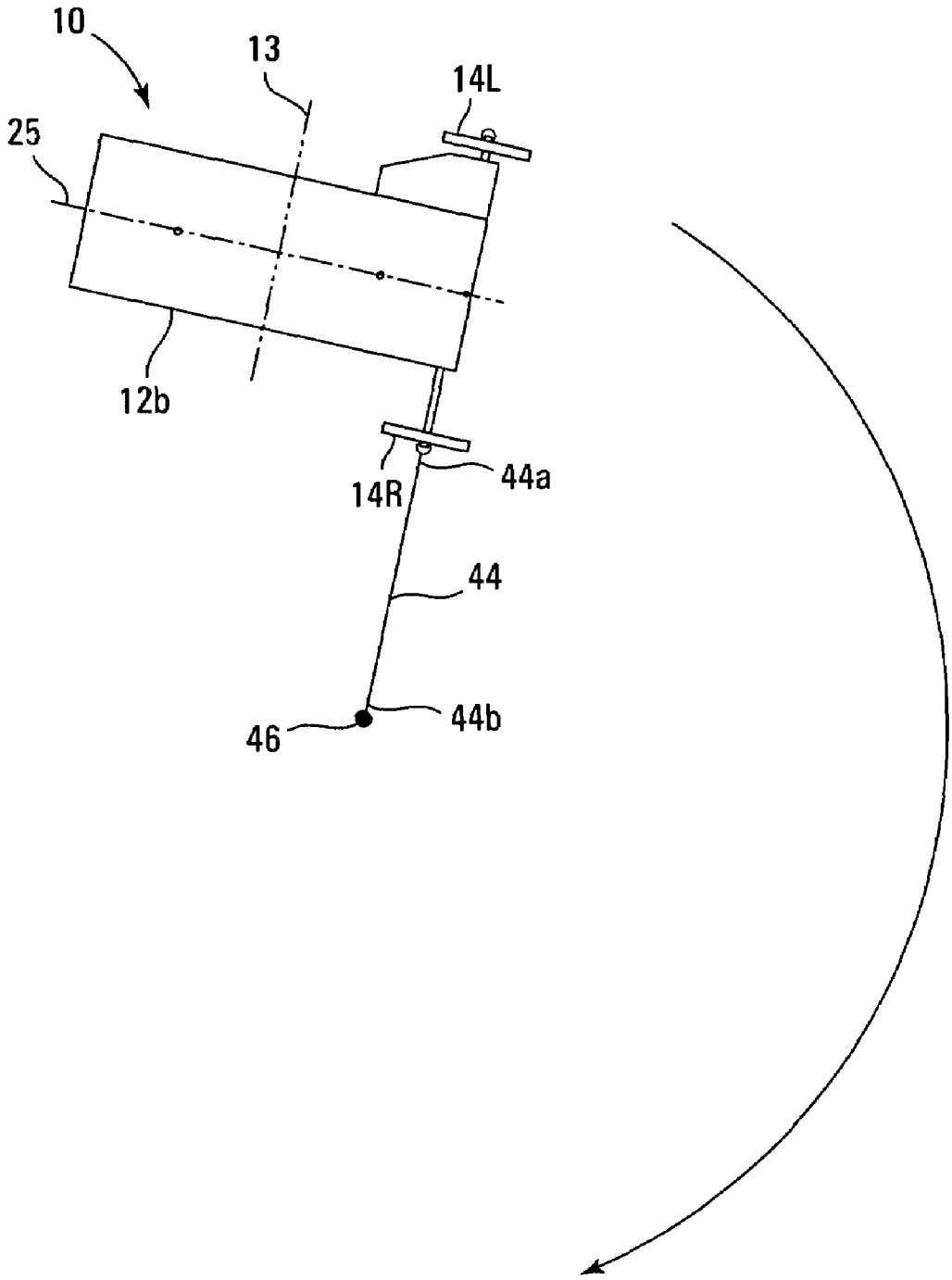
FIG. 4 is an aerial view of the embodiment of the moving target device shown in FIGS. 1-3 with the animal model removed for purposes of illustration, attached by a tether to a central pivot point.

As shown in FIGS. 1-3 the front left wheel 14L is provided with a swivel attachment 42L which functions to attach the moving target device 10 to a tether 44 as shown in FIG. 4. It should be mentioned that the front right wheel 14R is also provided with a swivel attachment 42R which will work equally well as an attachment for the tether 44, with the only difference being that the device 10 will pivot in the opposite direction than as shown in FIG. 4. The tether 44 is anchored to the ground or other surface by a pivot anchor 46 around which the moving target device 10 will pivot when energized. The pivot anchor 46 can be a metal stake (not shown), corkscrew anchor (not shown) or any other device capable of withstanding the centrifugal forces exerted by the moving target device 10 during normal use, thus preventing the moving target device 10 from escaping its arcuate path around the pivot anchor 46. It will be noted that the tether 44 is attached to the moving target device 10 at a point that is in the front half (unnumbered) of the device 10, in the example as shown, attached to the front right wheel 14R. The tether 44, however, could also be attached to the device at any point in the front half (unnumbered) of the device 10 where the tether 44 is outside the semi-spherical arc of either the front left wheel 14L or front right wheel 14R, depending on which side (right or left) of the device 10 the tether 44 is attached to. It is contemplated by and therefore within the scope of the invention that in one embodiment (not shown) the tether 44 could also be attached to a pylon that extends over or around the semi-spherical arc of one of the wheels 14L, 14R.

Figure 5:
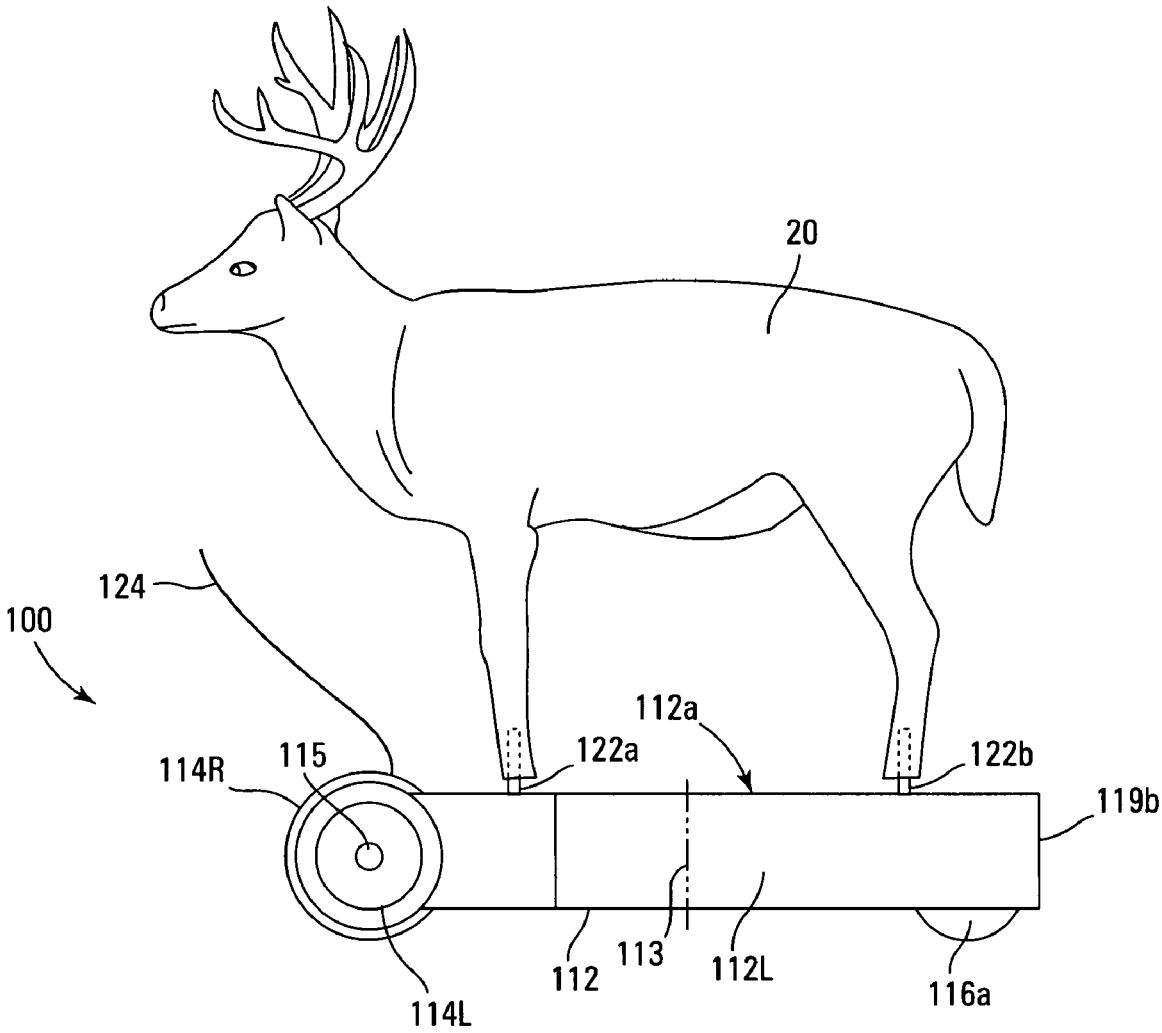
FIG. 5 is a side view of another embodiment of the moving target device of the present invention, with an animal model attached to the chassis.
Figure 6:
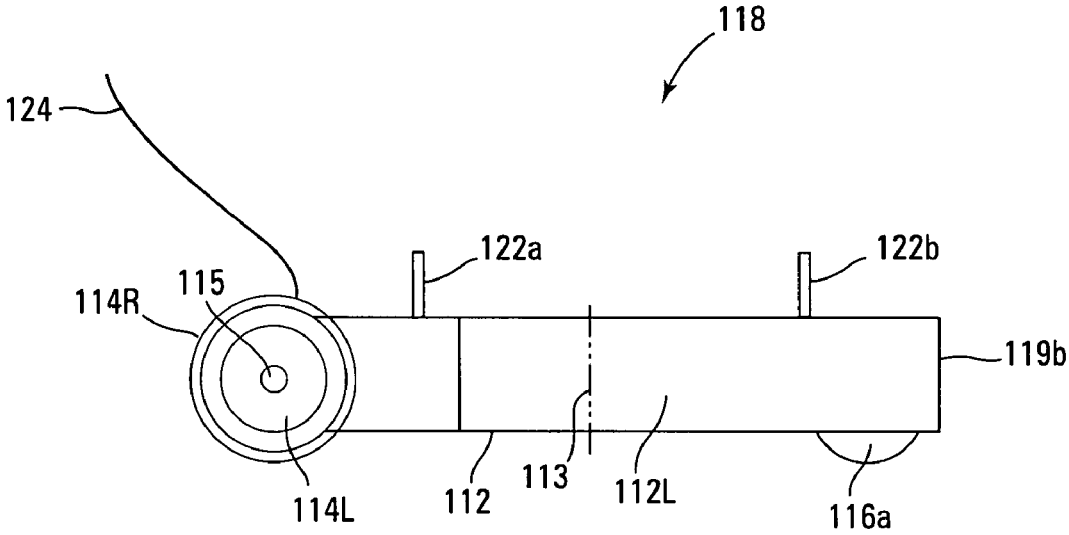
FIG. 6 is a side view of another embodiment of the moving target device of the embodiment shown in FIG. 5, without an animal model attached to the chassis.

FIG. 5 is a side view of an embodiment of the moving target device 100 of the present invention. It is seen that the moving target device 100 comprises a frame 112 on which all components are mounted, including a first wheel assembly 114 and a rear wheel assembly 116, to form a chassis 118, as best seen in FIG. 6. An animal model 20 is attached to the chassis 118 on a first stud 122*a* and a second stud 122*b* which extend upwardly from the chassis 118. For purposes of illustration, a representation of a deer is used as the animal model 20, however, it is understood that any animal or other kind of target may be represented and that the invention is thus not considered so limiting. It should also be noted that the animal model 20 could also be attached to the frame 112 by other methods such as fasteners, brackets etc. (not shown) and the invention should not therefore be considered as so limiting. An antenna 124 extends from the chassis 118 which is used to receive radio frequency signals that enables a user to remotely turn the moving target device 100 on and off, using a remote control unit 40.

Figure 7:
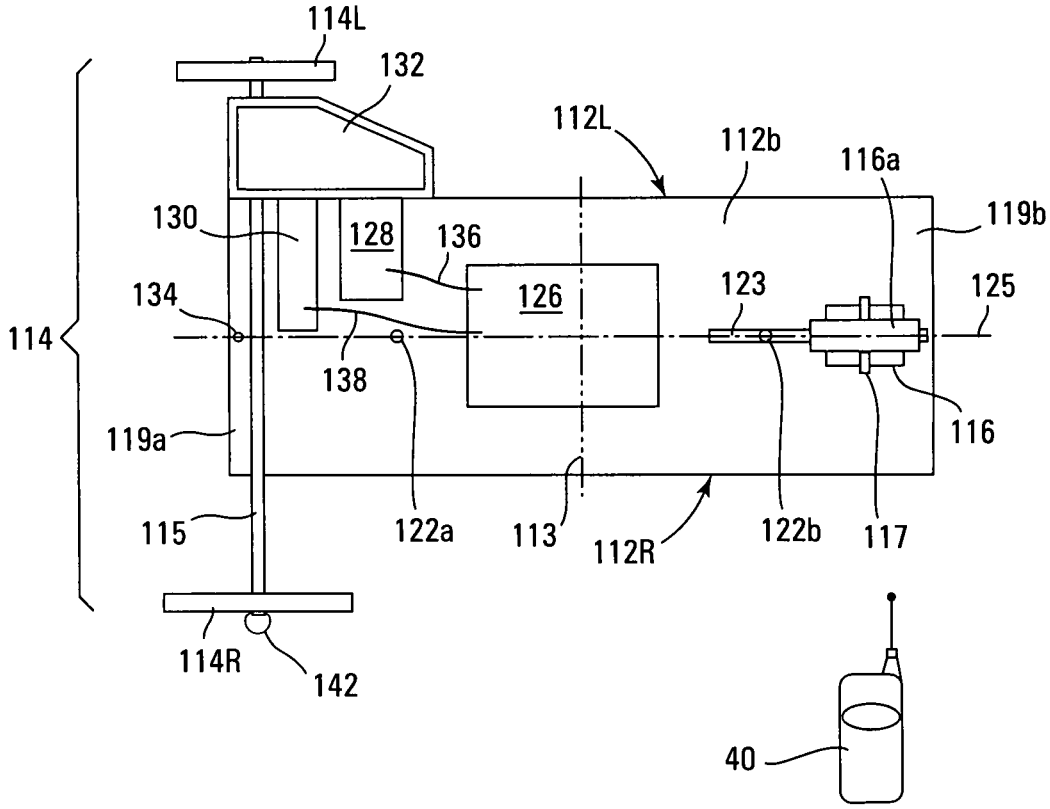
FIG. 7 is an under side view of the embodiment of the moving target device shown in FIGS. 5 and 6.

FIG. 7 is an underside view of the moving target device 100, showing the various components mounted thereon. It is seen that the frame 112 is the primary structural member and is made of aluminum or another similarly strong material, which in this embodiment is formed into a "U" configuration defining a top surface 112*a*, under surface 112*b*, left side 112L and right side 12R. A midpoint 113 is defined approximately halfway between a leading end 119*a* and a following end 119*b*. A longitudinal axis 125 is defined approximately halfway between the left side of the frame 112L and the right side of the frame 112R. Mounted to the underside 112*b* of the frame 112 are a battery 126, a servo gear motor 128, a wireless relay receiver 130 and a reduction gearbox 132, which is mechanically linked to the servo gear motor 128. Electrical connections 136, 138, such as wires function to provide electrical communication respectively between the battery 126 and the servo gear motor 132 and between the battery 126 and the wireless remote relay receiver 130. The first wheel assembly 114 comprises a first axle 115 which extends through the left side 112L and right side 112R of the frame 112 and has attached to its respective ends a left front wheel 114L and a right front wheel 114R. It will be noticed that in this embodiment of the moving target device 100 the front left wheel 114L is significantly smaller in diameter that the diameter of the front right wheel 114R, the significance of which is explained below. Referring to FIG. 7 it will be noticed that the rear wheel assembly 116 is in line with the longitudinal axis (unnumbered) of the frame 112, the significance of which is also explained below. On its left side (unnumbered) the first axle 115 is coupled to and further passes through the reduction gearbox 132 which is mechanically linked to the servo gear motor 128. The reduction gearbox 132 functions to reduce the relatively high speed revolutions achieved by the servo gear motor 128 to a lesser number of revolutions received by the first wheel assembly 114. This gives the moving target device 100 more power to travel over an uneven surface, at a realistic speed. Thus, when the servo gear motor 128 is energized by receiving electrical energy from the battery 126, it is caused to rotate and through its mechanical linkage to the reduction gear box 132, causes the first axle 115 to rotate, eventually causing the left front wheel 114L and the right front wheel 114R to rotate.

In one embodiment (not shown) energizing (i.e., turning the device on) of the moving target device 100 is initiated by closing a simple switch (not shown) in electrical communication with the battery 126 and mounted on the frame 112, then stepping out of the way and practicing hunting techniques. In the embodiment of the moving target device 100 as shown, the wireless (radio frequency) relay receiver 130 has an antenna 124 attached which extends approximately twelve to eighteen inches from the top surface 112*a* of the frame 112. An electrical connection (not shown) provides electrical communication between the antenna 124 and wireless relay receiver 130. The wireless relay receiver 130 is programmed to receive radio frequency signals from a remote transmitter 40 which in turn causes electrical energy to flow from the battery 126 to the servo gear motor 128.

Figure 8:
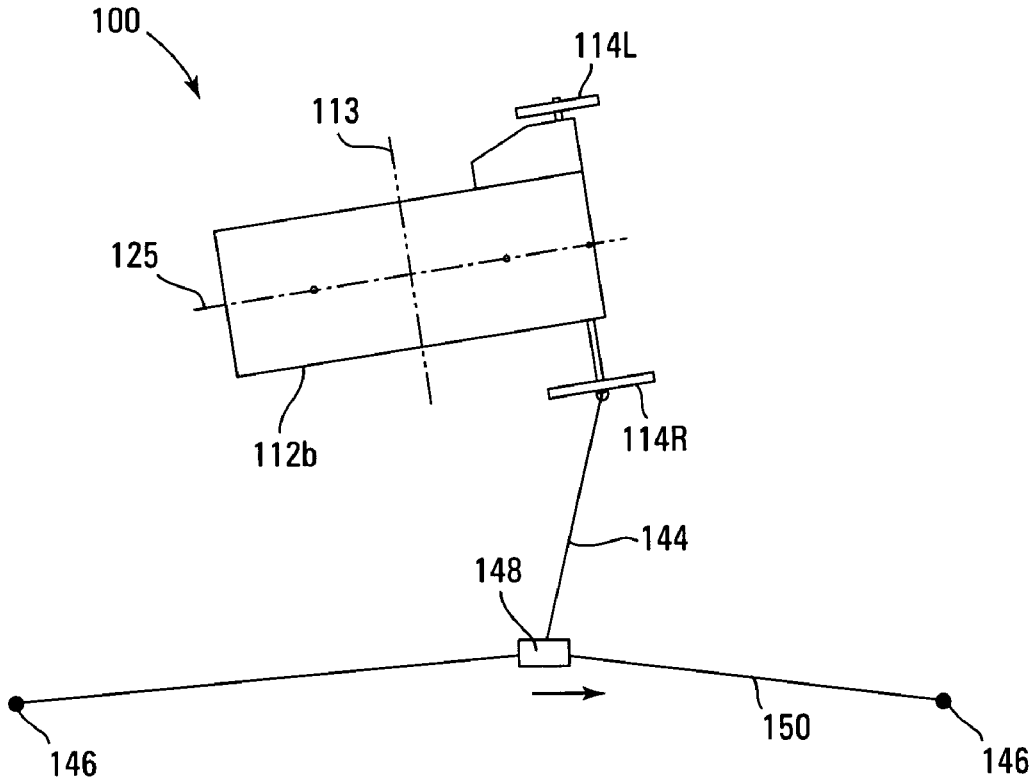
FIG. 8 is an aerial view of the embodiment of the moving target device shown in FIGS. 5-7 with the animal model removed for purposes of illustration, in use, attached to a primary tether, which is slidably attached to a secondary tether.

As shown in FIGS. 5-7 the front right wheel 114R is provided with a swivel attachment 142 which functions to attach the moving target device 100 to a primary tether 144 as shown in FIG. 8. It should be mentioned that in another embodiment (not shown) the front left wheel 114L could be attached, which would result in a device that traveled in the opposite direction. The swivel attachment 142 prevents the primary tether 144 from twisting as the moving target device follows its circuitous path when in use. The primary tether 144 is directly attached to a sliding coupling 148 which is hollow and through which slides a secondary tether 150, which is attached at both ends by pivot anchors 146. As shown in FIG. 8, the secondary tether 150 allows the moving target device 100 to travel in a substantially rectangular path, as discussed below. The pivot anchor 146 can be a metal stake (not shown), "corkscrew" anchor (not shown) or any other device capable of withstanding the centrifugal forces exerted by the moving target device 100 during normal use, thus preventing the moving target device 100 from escaping its path around the secondary tether 150. It will be noted that the primary tether 144 is attached to the moving target device 100 at a point that is in the front half (unnumbered) of the device 100, in the example as shown, attached to the front right wheel 114R. The primary tether 144, however, could also be attached to the device 100 at any point in the front half (unnumbered) of the device 100 where the primary tether 144 is outside the semi-spherical arc of either the front right wheel 114R or the front left wheel 114R, depending on which side (right or left) of the device 100 the primary tether 144 is attached to. It is contemplated by and therefore within the scope of the invention that in one embodiment (not shown) the primary tether 144 could be attached to a pylon (not shown) that extends over or around the semi-spherical arc of the front right wheel 114R.

As best shown in FIG. 8, when in use the moving target device 100 starts and eventually reaches one end of the secondary tether 150 and moves in a substantially straight path until the sliding coupling 148 reaches the end of the secondary tether 150. At that point, the primary tether 144 will pivot around the end of the secondary tether 150, upon the completion of which it will follow a substantially straight path until reaching the opposite end of the secondary tether 150, whereupon it will turn around and repeat its motion. In order for the moving target device 100 to be able to negotiate the pivoting motion at the end of the secondary tether 150 it is necessary for the device 100 to be exerting a bias toward the outside of its circuitous path. In this embodiment, this is achieved by having the outside or unattached wheel (in this embodiment the front left wheel 114L) be of a lesser diameter than the diameter of the inside or attached wheel (in this embodiment the front right wheel 114R). This configuration forces the moving target device 100 to constantly be attempting to turn outward within the limits of its constraint, away from the secondary tether 150, thus supplying the necessary bias to be able to pivot effectively.

Figure 9:
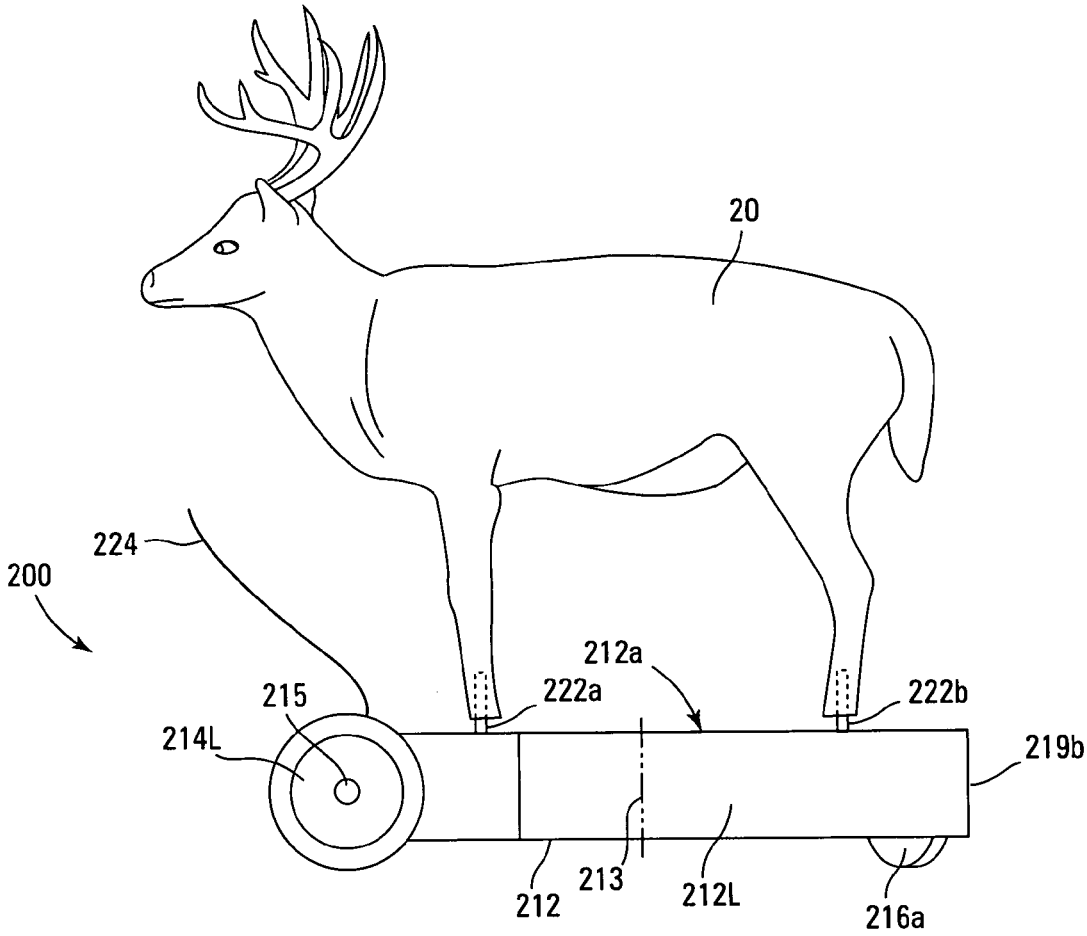
FIG. 9 is a side view of an alternative embodiment of the moving target device of the present invention, with an animal model attached to the chassis.
Figure 10:
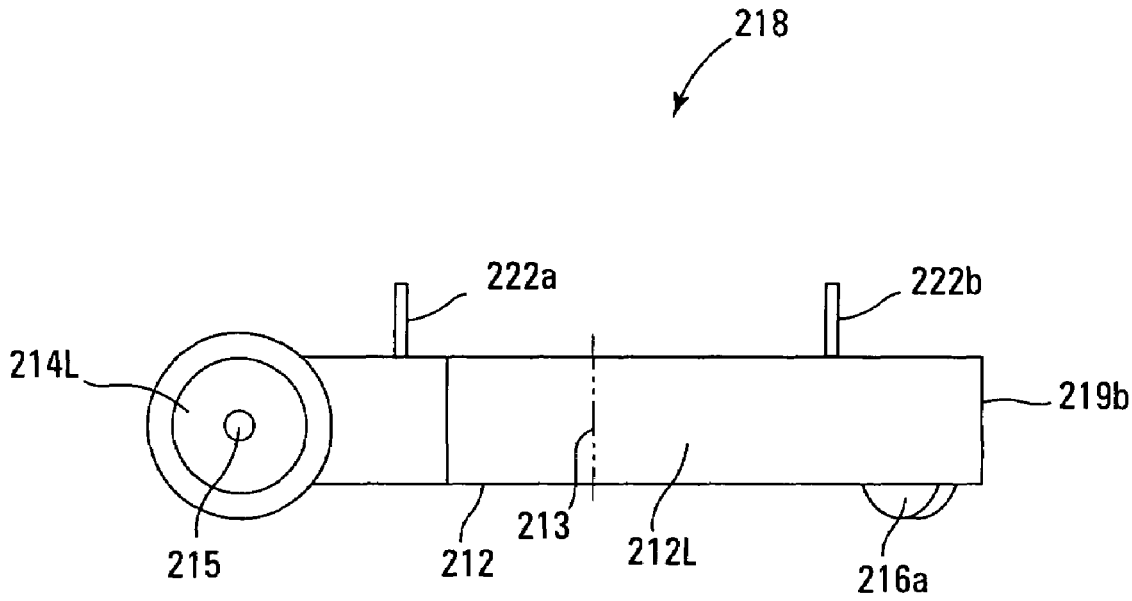
FIG. 10 is a side view of another embodiment of the moving target device of the embodiment shown in FIG. 9, without an animal model attached to the chassis.

FIG. 9 is a side view of an embodiment of the moving target device 200 of the present invention. It is seen that the moving target device 200 comprises a frame 212 on which all components are mounted, including a first wheel assembly 214 and a rear wheel assembly 216, to form a chassis 218, as best seen in FIG. 10. An animal model 20 is attached to the chassis 218 on a first stud 222*a* and a second stud 222*b* which extend upwardly from the chassis 218. For purposes of illustration, a representation of a deer is used as the animal model 20, however, it is understood that any animal or other kind of target may be represented and that the invention is thus not considered so limiting. It should also be noted that the animal model 20 could also be attached to the frame 212 by other methods such as fasteners, brackets etc. and the invention should not therefore be considered as so limiting. An antenna 224 extends from the chassis 218 which is used to receive radio frequency signals that enable a user to remotely turn the moving target device 200 on and off, using a remote control unit 40.

Figure 11:
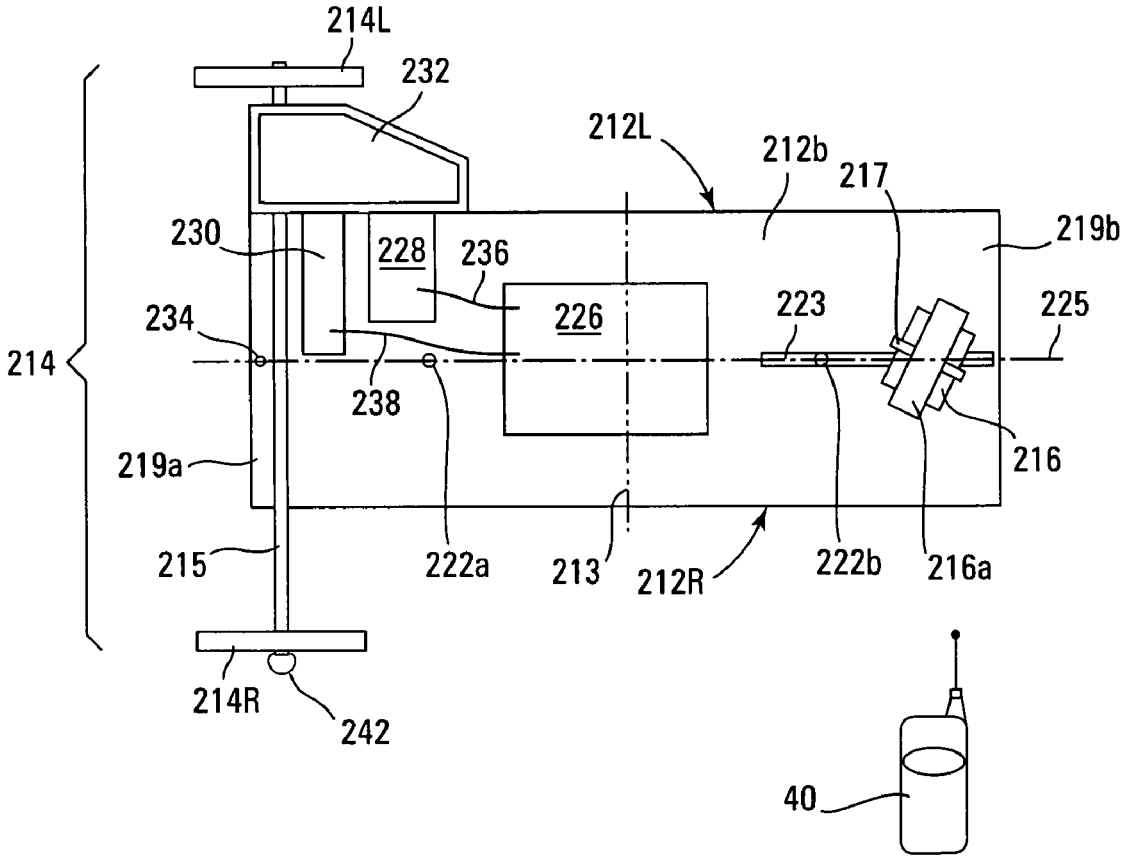
FIG. 11 is an under side view of the embodiment of the moving target device shown in FIGS. 9 and 10.

FIG. 11 is an underside view of the moving target device 200, showing the various components mounted thereon. It is seen that the frame 212 is the primary structural member and is made of aluminum or another similarly strong material, which in this embodiment is formed into a "U" configuration defining a top surface 212*a*, under surface 212*b*, left side 212L and right side 212R. A midpoint 213 is defined approximately halfway between a leading end 219*a* and a following end 219*b*. A longitudinal axis 225 is defined approximately halfway between the left side of the frame 212L and the right side of the frame 212R. Mounted to the underside 212*b* of the frame 212 are a battery 226, a servo gear motor 228, a wireless relay receiver 230 and a reduction gearbox 232, which is mechanically linked to the servo gear motor 228. Electrical connections 236, 238, such as wires function to provide electrical communication respectively between the battery 226 and the servo gear motor 232 and between the battery 226 and the wireless remote relay receiver 230. The first wheel assembly 214 comprises a first axle 215 which extends through the left side 212L and right side 212R of the frame 212 and has attached to its respective ends a left front wheel 214L and a right front wheel 214R. It will be noticed that in this embodiment of the moving target device 200 the front left wheel 214L and the front right wheel 214R have the same diameter, the significance of which is explained below. Referring to FIG. 11 it will be noticed that in this embodiment of the device 200, the rear wheel assembly 216 is canted or angled toward the inside from the longitudinal axis (unnumbered) of the frame 212, the significance of which will also be explained below. On its left side (unnumbered) the first axle 215 is coupled to and further passes through the reduction gearbox 232 which is mechanically linked to the servo gear motor 228. The reduction gearbox 232 functions to reduce the relatively high speed revolutions achieved by the servo gear motor 228 to a lesser number of revolutions received by the first wheel assembly 214. This gives the moving target device 200 more power to travel over an uneven surface, at a realistic speed. Thus, when the servo gear motor 228 is energized by receiving electrical energy from the battery 226, it is caused to rotate and through its mechanical linkage to the reduction gear box 232, causes the first axle 215 to rotate, eventually causing the left front wheel 214L and the right front wheel 214R to rotate.

In one embodiment (not shown) energizing (i.e., turning the device on) of the moving target device 200 is initiated by closing a simple switch (not shown) in electrical communication with the battery 226 and mounted on the frame 212, then stepping out of the way and practicing hunting techniques. In the embodiment of the moving target device 200 as shown, the wireless (radio frequency) relay receiver 230 has an antenna 224 attached which extends approximately twelve to eighteen inches from the top surface 212*a* of the frame 212. An electrical connection (not shown) provides electrical communication between the antenna 224 and wireless relay receiver 230. The wireless relay receiver 230 is programmed to receive radio frequency signals from a remote transmitter 40 which in turn causes electrical energy to flow from the battery 226 to the servo gear motor 228.

As shown in FIGS. 9-11 the front right wheel 214R is provided with a swivel attachment 242 which functions to attach the moving target device 200 to a primary tether 244 as shown in FIG. 8. It should be mentioned that in another embodiment (not shown) the front left wheel 214L could be attached, which would result in a device that traveled in the opposite direction. The swivel attachment 242 prevents the primary tether 244 from twisting as the moving target device follows its circuitous path when in use. The primary tether 244 is directly attached to a sliding coupling 248 which defines a hollow portion through which slides a secondary tether 250, which is attached at both ends by pivot anchors 146. As shown in FIG. 8, the secondary tether 250 allows the moving target device 200 to travel in a substantially rectangular path, as discussed below. The pivot anchor 146 can be a metal stake (not shown), "corkscrew" anchor (not shown) or any other device capable of withstanding the centrifugal forces exerted by the moving target device 200 during normal use, thus preventing the moving target device 200 from escaping its path around the secondary tether 250. It will be noted that the primary tether 244 is attached to the moving target device 200 at a point that is in the front half (unnumbered) of the device 200, in the example as shown, attached to the front right wheel 214R. The primary tether 244, however, could also be attached to the device 200 at any point in the front half (unnumbered) of the device 200 where the primary tether 244 is outside the spherical arc of either the front right wheel 214R or the front left wheel 214R, depending on which side (right or left) of the device 200 the primary tether 244 is attached to. It is contemplated by and therefore within the scope of the invention that in one embodiment (not shown) the primary tether 144 could be attached to a pylon (not shown) that extends over or around the spherical arc of the front right wheel 214R.

Figure 12:
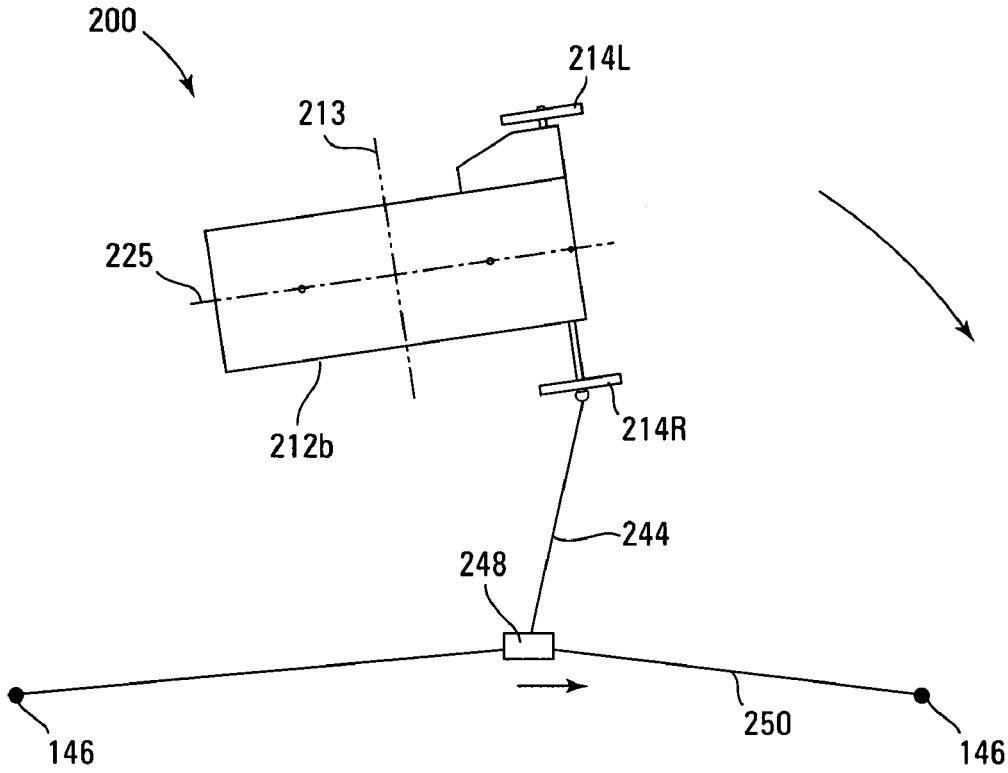
FIG. 12 is an aerial view of the embodiment of the moving target device shown in FIGS. 9-11 with the animal model removed for purposes of illustration, in use, attached to a primary tether, which is slidably attached to a secondary tether.

As best shown in FIG. 12, when in use the moving target device 200 starts and eventually reaches one end of the secondary tether 250 and moves in a substantially straight path until the sliding coupling 248 reaches the end of the secondary tether 250. At that point, the primary tether 244 will pivot around the end of the secondary tether 250, upon the completion of which it will follow a substantially straight path until reaching the opposite end of the secondary tether 250, whereupon it will turn around and repeat its motion. In order for the moving target device 200 to be able to negotiate the pivoting motion at the end of the secondary tether 250 it is necessary for the device 200 to be exerting a bias toward the outside of its circuitous path. In this embodiment, this is achieved by canting or angling the rear wheel assembly 216 toward the inside of the circuitous path defined by the moving target device 200. This configuration forces the following end 219*b* of the moving target device 200 to move toward the secondary tether 250 and thus constantly be attempting to turn outward within the limits of its constraint, away from the pivot anchor 146, thus supplying the necessary bias to be able to pivot effectively.

Materials used to construct the moving target device 10, 100, 200 include but are not limited to aluminum either bent or extruded to form the frame 12, 112, 212. The front wheels 14L, 14R, 114L, 114R, 214L, 214R can be ordinary wheels such as used for a lawn mower or could also be small pneumatic wheels. The rear wheels 16*a*, 116*a*, 216*a* can be smaller versions of the front wheels 14L, 14R, 114L, 114R, 214L, 214R or can be a solid rubber roller type of wheel. The battery 26, 126, 226 is a rechargeable 6 volt sealed lead acid type such as AGM UB610 made by Universal Power Group. An advantage of a sealed battery is that it can be mounted to the frame 12, 112, 212 in an inverted manner. A suitable servo gear motor 28, 128, 228 is a Mabuchi RS550 DC motor. The reduction gear box 32, 132, 232 can be a plastic reduction gearbox, such as used on a child's riding toy. The wireless relay receiver 30, 130, 230 and remote 40 is made by Tru Motion and distributed by Expedite International.

It should be mentioned that the tether 44 and primary tether 144, 244 can be made of any material strong enough to withstand the forces generated when the moving target device 10, 100, 200 is in motion such as nylon rope, heavy duty fishing line, metal cable etc. The tether 44 and primary tether 144, 244 can be of any length appropriate to the type of practice shooting being done. In one embodiment (not shown) the tether 44 and primary tether 144, 244 can be rolled onto a convenient reel system (not shown) to more easily facilitate adjusting the length of the tether 44 and primary tether 144, 244 and therefore the turning radius. When the moving target device 10, 100, 200 is used in an indoor environment or on a hard surface such as concrete, the wheels 14L, 14R, 16*a*, 114L, 114R, 116*a*, 214L, 214R, 216*a* should be of a type having no tread (not shown) or other kind of gripping surface, to enable the moving target device to slide across the relatively hard surface, enabling a turning motion to be made.

Use

Using the powered moving target device 10, 100, 200 initially requires selection of a surface upon which to use the device 10, 100, 200. It is necessary to be certain that the battery 26, 126, 226 is charged to be able to power the device 10, 100, 200 for the duration of the practice session. For the moving target device 10 the tether 44 is anchored to the surface using a pivot anchor 46 or other anchoring device (not shown) and then attached to the moving target device 10 at the swivel attachment 42L or 42R. For the moving target devices 100, 200 the primary tether 144, 244 is attached to the slider coupling 148, 248 followed by anchoring the secondary tether 150, 250 at both ends by pivot anchors 146 or other anchoring devices (not shown). The device 10, 100, 200 is then energized using the wireless remote transmitter 40. As described above, the moving target device 10, 100, 200 travels in a circuitous path around either the pivot anchor 46 or the secondary tether 150, 250. The shooter practices by shooting arrows, bullets or other weapons at the animal model 20 or other target, as long as the device 10, 100, 200 has sufficient energy or as long as necessary.

What is claimed is:

1. A moving target device, comprising:

a. a frame, defining a right side, a left side, a longitudinal axis, a leading end, a following end and a midpoint, with mounting means for attaching an animal model to the frame;

b. a first wheel assembly defining a left wheel and a right wheel separated by and attached to an axle;

c. a second wheel assembly attached to the frame, the first and second wheel assemblies together supporting and allowing the moving target device to be easily moved over a surface, wherein the first wheel assembly is attached to the frame proximate to the leading end and second wheel assembly is attached to the frame proximate to the following end;

d. a motor coupled to the first wheel assembly, causing rotation of the first wheel assembly when the motor is energized; and e. a tether defining a first end and a second end, the tether attached to the frame at a position beyond an area defined by the outer dimensions of the first wheel assembly so as to clear the first wheel assembly during movement, the tether attached at the first end to the frame at a point between the leading end and the midpoint and at the second end to a surface, wherein the first end of the tether is attached to the right side of the moving target device, and wherein the first end of the tether is attached to the right wheel on the first wheel assembly, allowing the moving target device to travel in a circuitous path when the motor is energized.

2. The moving target device of claim 1 wherein the left wheel and right wheel are equal in size.

3. The moving target device of claim 2 wherein the second wheel assembly defines a single wheel.

4. The moving target device of claim 3 wherein the single wheel is mounted to the frame to rotate parallel with the longitudinal axis.

5. The moving target device of claim 1 wherein the second end of the tether is attached to a pivot anchor around which the moving target device will rotate in a circular path when the motor is energized.

6. The moving target device of claim 1 wherein the energy to the motor emanates from a battery.

7. The moving target device of claim 6 wherein the motor can be remotely turned on by a remote transmitter sending radio frequency signals to a wireless relay receiver in electrical communication with the motor and the battery.

8. A moving target device, comprising:

a. a frame, defining a right side a left side, a longitudinal axis, a leading end, a trailing end and a midpoint, with mounting means for attaching an animal model to the frame;

b. a first wheel assembly attached proximate to the leading end of the frame, defining an outside wheel and an inside wheel separated by and attached to an axle;

c. a second wheel assembly attached proximate to the trailing end of the frame, the first and second wheel assemblies together supporting and allowing the moving target device to be easily moved over a surface;

d. a motor coupled to the first wheel assembly, causing rotation of the first wheel assembly when the motor is energized; and e. a tether attached to an inside part of the frame as the moving target device travels in a circuitous path, the tether attached at one end to the frame at a position beyond an area defined by the outer dimensions of the inside wheel so as to clear the inside wheel during movement and at a point between the leading end and the midpoint and attached at another end to a surface;

wherein the inside wheel of the first wheel assembly defines a greater diameter than a diameter defined by the outside wheel, causing the tethered moving target device to exert a bias against the tether when the moving target device is moving.

9. The moving target device of claim 8 wherein the tether is attached to the right side of the moving target device.

10. The moving target device of claim 9 wherein the first end of the tether is attached to the inside wheel.

11. The moving target device of claim 8 wherein the second wheel assembly defines a single wheel.

12. The moving target device of claim 11 wherein the single wheel is mounted to rotate parallel with the longitudinal axis.

13. The moving target device of claim 8 further comprising a primary tether attached at one end to the moving target device and attached at another end to a secondary tether by a sliding coupling, the secondary tether anchored to a surface at two ends, the sliding coupling allowing the moving target device to travel in a substantially straight path along the secondary tether until reaching one anchored end of the secondary tether, then reversing direction by pivoting around the anchored end of the secondary tether.

14. The moving target device of claim 8 wherein the energy to the motor emanates from a battery.

15. The moving target device of claim 14 wherein the motor can be remotely turned on by a remote transmitter sending radio frequency signals to a wireless relay receiver in electrical communication with the motor and the battery.

16. A moving target device, comprising:

a. a frame, defining a longitudinal axis, a leading end a trailing end, and a midpoint, with mounting means for attaching an animal model to the frame;

b. a first wheel assembly attached proximate to the leading end of the frame, defining an outside wheel and an inside wheel separated by and attached to an axle;

c. a second wheel assembly attached to the frame proximate to the trailing end, the first and second wheel assemblies together supporting and allowing the moving target device to be easily moved over a surface;

d. a motor coupled to the first wheel assembly, causing rotation of the first wheel assembly when the motor is energized; and e. a tether attached to an inside part of the frame at a position beyond an area defined by the outer dimensions of the inside wheel so as to clear the inside wheel during movement, the tether attached at one end to the frame at a point between the leading end and the midpoint and anchored at the other end to a surface, allowing the moving target device to travel in a circuitous path when the motor is energized;

wherein the second wheel assembly is canted towards the inside wheel, causing the tethered moving target device to exert a bias against the tether when the moving target device is moving.

17. The moving target device of claim 16 wherein the tether is attached to the right side of the moving target device.

18. The moving target device of claim 17 wherein the first end of the tether is attached to the inside wheel.

19. The moving target device of claim 16 wherein the second wheel assembly defines a single wheel.

20. The moving target device of claim 16 further comprising a primary tether attached at one end to the moving target device and attached at another end to a secondary tether by a sliding coupling, the secondary tether anchored to a surface at two ends, the sliding coupling allowing the moving target device to travel in a substantially straight path until reaching one anchored end of the secondary tether, then reversing direction by pivoting around the anchored end of the secondary tether.

21. The moving target device of claim 16 wherein the outside wheel and the inside wheel are approximately equal in diameter.

22. The moving target device of claim 16 wherein the motor can be remotely turned on by a remote transmitter sending radio frequency signals to a wireless relay receiver in electrical communication with the motor and a battery.

* * * * *